US012714268B2

(12) United States Patent
Yeung

(10) Patent No.: US 12,714,268 B2
(45) Date of Patent: Aug. 25, 2026

(54) METHODS FOR PRODUCING AND USING CORELESS ROLLER FOR TOILET PAPER

(71) Applicant: Hon Fai Yeung, Hong Kong (HK)

(72) Inventor: Hon Fai Yeung, Hong Kong (HK)

( * ) Notice: Subject to any disclaimer, the term of this patent is extended or adjusted under 35 U.S.C. 154(b) by 231 days.

(21) Appl. No.: 18/616,492

(22) Filed: Mar. 26, 2024

(65) Prior Publication Data

US 2025/0281009 A1 Sep. 11, 2025

(30) Foreign Application Priority Data

Mar. 5, 2024 (HK) ..... 32024088262.3

(51) Int. Cl.
*A47K 10/32* (2006.01)

(52) U.S. Cl.
CPC ..... *A47K 10/32* (2013.01); *A47K 2010/3206* (2013.01); *A47K 2010/3233* (2013.01)

(58) Field of Classification Search
CPC ..... A47K 10/32
See application file for complete search history.

(56) References Cited

U.S. PATENT DOCUMENTS 5,480,060 A * 1/1996 Blythe ..... A47K 10/421 221/45
5,609,269 A * 3/1997 Behnke ..... B65H 75/00 221/48
6,056,235 A * 5/2000 Brozinsky ..... A47K 10/32 242/598.6
6,092,758 A * 7/2000 Gemmell ..... A47K 10/40 242/596.7
10,710,832 B2 * 7/2020 Rozek ..... A47K 10/38
2002/0074450 A1 * 6/2002 Tramontina ..... A47K 10/32 242/613.5
2008/0245693 A1 * 10/2008 Vinson ..... A47K 10/16 206/412
2015/0150422 A1 * 6/2015 Ochoa, Sr. ..... A47K 10/16 242/596.7
2018/0194582 A1 * 7/2018 Rozek ..... A47K 10/38

* cited by examiner

*Primary Examiner* — Gene O Crawford
*Assistant Examiner* — Ayodeji T Ojofeitimi
(74) *Attorney, Agent, or Firm* — Rivka Friedman

(57) ABSTRACT

The invention discloses a coreless roller for toilet paper, including: a hollow cylinder body and a side strip. The hollow cylinder body is provided with a groove on the outer side wall. The groove is filled by the side strip. The roller allows the coreless rolling paper to be easily adapted to the toilet bracket of the toilet. The user does not need to replace the original bracket, which saves costs and also reduces waste. It is easy to install and use, and good for environmental protection. Through the use of this coreless toilet paper roller, it solves the problem of the coreless rolling paper in the family use. It also promotes the application of environmental protection concepts in daily life, so as to make life greener.

10 Claims, 1 Drawing Sheet

METHODS FOR PRODUCING AND USING CORELESS ROLLER FOR TOILET PAPER

TECHNICAL FIELD

The present invention relates to the technical field of laminated material production in particular to a coreless toilet paper roller.

BACKGROUND

There are some innovative methods trying to turn the discarded paper cores into useful items, such as handicrafts and small storage containers. These methods are often time-consuming and labor-intensive. It is difficult to popularize them in every household. Moreover, these methods do not fundamentally solve the problem of household paper rolls generating a large number of waste paper tube cores.

There exists a coreless rolling paper that does not use the core of the paper roller. This kind of rolling paper not only reduces the waste of paper tube core, but also reduces the production cost. However, whether to use coreless or core is not a unified standard, and with the supporting frame is also non-standard parts, it turns out the consumers are not able to determine its applicability, thus affecting the popularity of the coreless rolling paper.

The market also appeared on the solid core rolls and with cardboard made of hollow paper tube roller. While solid rolls eliminate core waste, they do not have a core to support and require a specialized holder to use. This support is often more complex. It increases manufacturing costs, and cause problems in daily use. For cardboard made of hollow paper tube, when the roll of paper is used up, these cardboards made of paper tube is still garbage.

To resolve the problem, firstly manufacturers should actively promote the research and development and production of coreless rolling paper, and formulate corresponding standards to ensure the versatility and ease of use of coreless rolling paper. Secondly, the government and relevant departments should introduce relevant policies to encourage and support the production and sale of environmentally friendly rolling papers, and at the same time strengthen the regulation and publicity on the recycling of waste paper tube cores. Finally, as consumers, we should also start from ourselves, improve environmental awareness, choose environmentally friendly rolling paper, reduce waste, and contribute to the earth.

SUMMARY

The present invention proposes a coreless roller for toilet paper capable of making coreless rolling paper at home by means of the roller of the present embodiment, so as to unify the standard to form coreless roller for use at home, and to place it directly on a toilet holder at home for pulling out the paper.

A coreless roller for toilet paper according to an embodiment of the first aspect of the present invention, comprising: a hollow cylinder body and a side strip, a groove is provided on an outer side wall of the hollow cylinder body, and this groove is filled by the side strip.

The outer surface of the hollow cylinder body and the outer side of the side strip are smooth. It enables the cylinder body and the side strip to be easily removed from the rolled toilet paper. The roller can be removed from either side when the rolled paper is fully sleeved on the roller.

A groove in the cylinder body runs axially through its outer side wall, and the side strip fills the groove. The groove and the side strip are substantially complementary in cross-sectional shape and not entirely geometrically complementary. The groove has a trapezoidal characteristic shape in cross-section and it is wider on the outside and narrower on the inside. There is a gap between the inner face of the side strip and the base of the groove opposite thereto;

The inner side of the side strip and the bottom of the groove opposite thereto may both be provided with magnetic attractor, or the side strip may be allowed to be fixed in the recess of the barrel body in the form of a snap fastener, and the side strip may be made of plastic or iron sheet material.

If fixed by snap fasteners, the two ends of the groove are fitted with toggle iron or rubber sheet, and when the side strip is pressed in the groove, the iron or rubber sheet is toggled to fix the side strip.

If the magnetic fixing is used, the magnetic attractors are evenly distributed in dots along the axial direction of the cylinder.

This solution is preferred to the magnetic fixation of the side strip, because after a long period of time toggle the iron sheet or film, the rotating bit will be fatigue phenomenon, it is likely to fall out of the barrel body, while the magnetic structure does not happen.

The radial width of the outer edge of the groove is about one finger's width. It is also the outer width of the side strip, so that it is convenient for the side strip to be taken out axially from the rolled paper;

The entire hollow cylinder body can be used with a power device to roll toilet paper, and is also capable of being used with a telescoping roller or with a conventional toilet paper holder that is not a roller.

The material of the cartridge and the side strip of the roller is preferably plastic.

The method of using the roller is as follows: take out the side strip on the roller, the user puts the end edge part of the last compartment of the coreless rolling paper into the groove of the barrel body, and then press the side strip on the paper in the groove, so that the beginning end of the paper is pressed into the groove, and then rotates the roller until the whole roll of toilet paper is completely set in the roller, and then the user can pull out the roller, it can be used inside the traditional toilet paper tube or like the traditional toilet paper holder. Afterwards, the roller can be withdrawn and placed in a conventional toilet paper tube or placed on a toilet paper holder in a toilet as a normal core roll.

For the production method of the roller, when the magnetic attractor fixing method is adopted, a cylinder body suitable for the inner and outer diameters is firstly manufactured, and then cut into specified unit lengths, and then axial grooves are shaved on the outer wall of the cut cylinder body, and holes are drilled at the bottom of the grooves. Magnetic attractors are put into the holes and fixed by using glue; the side strip is made according to the dimensions of the grooves and the magnetic attractor corresponding to the holes are fixed by using glue in the inner part of the side strip so that the roller can be put into a conventional toilet paper holder or directly used like ordinary cored toilet paper in a toilet paper holder. The magnetic attractors in the holes make the inner side of the side strip and the bottom of the recess opposite thereto attract each other, or the entire inner side of the side strip can be affixed with a magnetizable metal strip.

A coreless rolling paper roller according to an embodiment of the present invention has at least the following beneficial effects:

1. From the perspective of environmental protection, coreless rolling paper is undoubtedly a great progress. The traditional core-winding paper consumes a large amount of tree resources in the production process. It causes damage to the natural environment and increases carbon emissions.
2. From an economic point of view, coreless rolling paper also shows its unique advantages. Since its production process eliminates the manufacturing process of paper tube core, its cost is lower, hence its price is naturally more affordable. In addition, the length of coreless rolls is often longer than core rolls. Consumers can get more toilet paper usage, more cost-effective at the same price.
3. In terms of opening up new market, coreless toilet paper rolls also have great potential. With the growing concern for environmentally friendly products, coreless rolling paper may occupy a place in some core rolling paper market to fill the market gap. This provides new development opportunities for manufacturers and allows the general public to increase their choices when purchasing toilet paper.

BRIEF DESCRIPTION OF THE DRAWINGS

Figure 1:
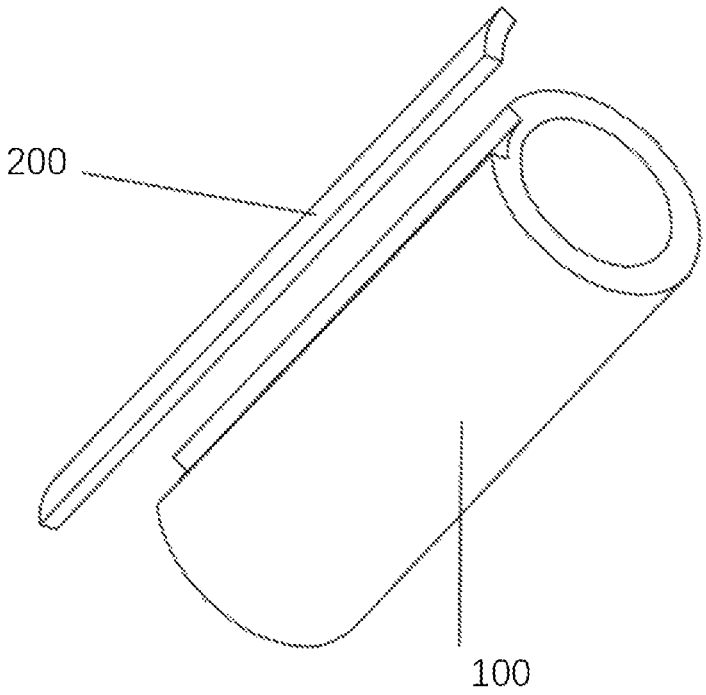
Figure 2:
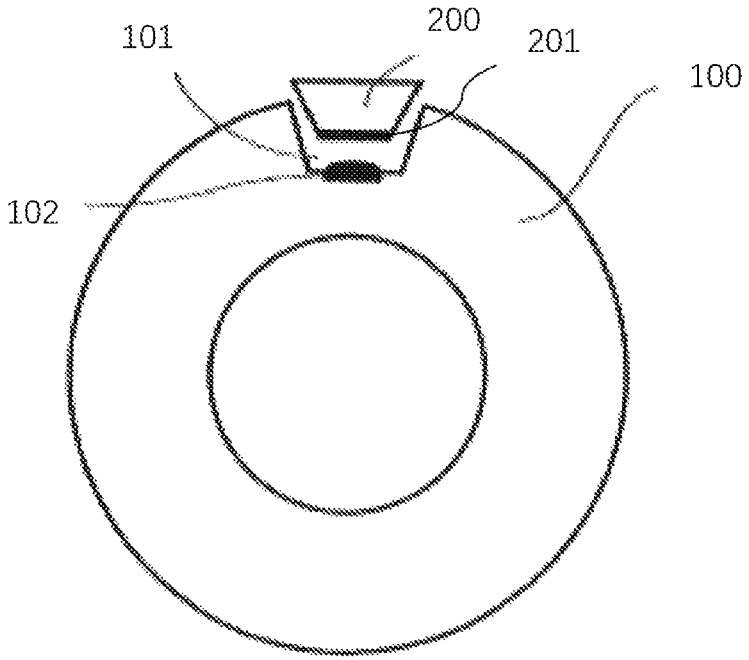

Having thus described the invention in general terms, reference will now be made to the accompanying drawings, which are not necessarily drawn to scale, and wherein:

FIG. 1 shows a schematic structural diagram of an embodiment of the present invention;

FIG. 2 shows a cross-sectional view of an embodiment of the present invention;

REFERENCE SIGNS LIST

100—hollow cylinder body
200—side strip
101—groove
102/201—magnetic attractor

DETAILED DESCRIPTION

Referring to FIGS. 1 to 2, a coreless roller for toilet paper comprising: a hollow cylinder body 100 and a side strip 200. The groove 101 is provided on the outer side wall of the hollow cylinder body 100, and this groove 101 is filled by the side strip 200.

The outer surface of the hollow cylinder body 100 and the outer side of the side strip 200 are smooth. The cylinder body and the side strip 200 to be easily removed from the rolled toilet paper. The roller can be removed from either side when the rolled paper is fully sleeved on the roller. The length of the cylinder body is comparable to the rolled paper generally sold on the market. The outer diameter may be 43 mm and the length may be 100-130 mm (preferably 110 mm). The rolled paper exceeding a width of 120 mm will be difficult to be used on a conventional toilet paper tube or toilet paper holder. It is not recommended that consumers purchase coreless rolled paper with a width of more than 110 mm.

A groove 101 runs along the cylinder body 100 in an axial direction through its outer side wall and a side strip 200 fills the groove 101. The groove 101 and the side strip 200 are substantially complementary in cross-sectional shape and not completely geometrically complementary. The cross-section of the groove 101 is in the shape of trapezoidal features with a wide outer width and a narrow inner width. There is a certain gap between the inner face of the side strip 200 and the bottom of the groove 101 opposite thereto. For example, a gap of 1 mm (about 4 ply thickness will not cause the outer side of the side strip 200 to protrude from the groove 101 of the roller) is able to cooperate with different thicknesses of toilet paper on the market, which can avoid being torn.

Magnetic attractor 102, 201 is provided on both the inner side of the side strip 200 and the bottom of the groove 101 opposite thereto. The side strip 200 may be allowed to be fixed in the form of snap fasteners in the groove 101 of the cartridge body. The side strip 200 may be made of plastic or iron sheet material.

If snap fastening is used, toggle-able iron or film sheets are fitted at both ends of the groove 101. When the side strip 200 is pressed against the groove 101, the toggle-able iron or film sheets hold the side strip 200 in place.

If the magnetic attractors 102, 201 are used for fixing, they are evenly distributed along the axial direction of the cylinder (the number of evenly distributed friction force is appropriate in order that the paper will not be damaged when the side strip 200 are withdrawn), so that the toilet paper is pulled with an even force to avoid being torn along the radial direction of the cylinder when it is rolled up. The main purpose of adopting the magnetic attractors 102, 201 is to be able to pull the smooth outer surface of the rolled toilet paper without destroying the toilet paper. The number and distribution of the magnetic attractors 102, 201 is decided after testing. If the magnetic attractors 102, 201 is too many or too dense, it will lead to strong magnetic force when the roller is pulled out. It is very easy to tear the toilet paper while the magnetic attractors 102, 201 is too little, it leads to insufficient magnetic force. The side strip 200 can not be compacted toilet paper. When the cylinder body is rotated, the paper will come loose and leave the groove 101.

This solution is preferred to magnetically fix the side strip 200, because after a long time, the iron sheet or film, the rotating bit will be fatigue phenomenon. It is likely to fall out of the cylinder body, but the magnetic attractor does not happen.

The radial width of the outer edge of the groove 101 is about one finger's width, so it is convenient for the side strip 200 to be took out from the rolled paper along the axial direction;

The entire hollow cylinder body can be used with a power device to roll toilet paper. It is also capable of being used with a telescoping roller or with a conventional toilet paper holder.

The cylinder body and side strip 200 material are preferred for plastic, because the roller is in the toilet for a long time in a humid environment. With other materials, such as recycled wood, there is a great chance of mold and bacteria. The use of plastic does not have this disadvantage and the use of plastic manufacturing cost is relatively inexpensive.

The method of using the roller is as follows: Remove the side strip 200 on the roller, the user will put the end edge of the last frame of the coreless rolling paper into the groove 101 of the cylinder body and then press the side strip 200 on the paper in the groove 101. The beginning end of the paper will be pressed into the groove 101. Rotate the roller until the whole roll of paper is completely set on the roller (it can be drove by manually or by electric tool). When the coreless roll of paper rolled in the roller completely set in the whole roll of paper, the roller of the cylinder body from the left or right with a little force a push, the user can easily top out the cylinder body. Put the roller of paper on the traditional roll of paper tube wrapped can be used, the roller of paper is extracted from the inner (to the outer). It can be placed in the traditional toilet paper tube to use or like ordinary core rolled paper in the toilet paper holder on the toilet paper (when the coreless rolled paper rolled completely in the roller, and then put into the toilet paper holder of the telescopic roller. It can be used directly, and the rolled paper is extracted from the outer to the inner).

For the production method of the roller, when the magnetic attractor fixing method is used, a cylinder body 100 suitable for the inner and outer diameters is first manufactured, and then cut into specified unit lengths. The axial grooves 101 are planned on the outer side walls of the cut cylinder body 100. The holes are drilled in the bottoms of the grooves 101 and magnetic attractors 102, 201 are placed in the holes, and fixed by utilizing glue; According to the size of the grooves 101, the side strip 200 is made according to the size of the groove 101 and the magnetic attractors 102, 201 corresponding to the holes are fixed with glue in the inner side portion of the side strip 200. The inner side of the side strip 200 and the bottom of the groove 101 opposite thereto are attracted to each other and a magnetizable metal strip can also be affixed to the entire inner side portion of the side strip 200.

The embodiments of the present invention are described in detail above in conjunction with the accompanying drawings, but the present invention is not limited to the above embodiments, and various changes may be made within the scope of knowledge possessed by persons of ordinary skill in the technical field to which it belongs without departing from the purpose of the present invention.

What is claimed is:

1. A coreless roller for a paper roll, the coreless roller comprising:

a hollow cylinder body (100) having an outer sidewall, the hollow cylinder body (100) defining a groove (101) extending axially through the outer sidewall; and a side strip (200), configured to be removably disposed within the groove (101);

wherein an outer surface of the hollow cylinder body (100) and an outer side of the side strip (200) are smooth such that the coreless roller is configured to be axially removed from a paper roll sleeved thereon; and wherein the side strip (200) is secured within the groove (101) by magnetic attractors (102, 201).

2. The coreless roller according to claim 1, wherein the magnetic attractors (102, 201) are evenly distributed along an axial direction of the hollow cylinder body (100).

3. The coreless roller according to claim 1, wherein the groove (101) and the side strip (200) have substantially complementary cross-sectional shapes, and wherein the groove (101) has a trapezoidal cross-section that is wider at the outer sidewall and narrower at a bottom of the groove (101).

4. The coreless roller according to claim 3, where a gap is defined between an inner side of the side strip (200) and the bottom of the groove (101) when the side strip (200) is disposed within the groove (101).

5. The coreless roller according to claim 4, wherein the gap is dimensioned such that the outer side of the side strip (200) does not protrude beyond the groove (101).

6. The coreless roller according to claim 2, wherein the magnetic attractors (102, 201) are evenly distributed in dots along the axial direction of the cylinder.

7. A method for using a coreless roller to form a paper roll, comprising the steps of:

removing a side strip (200) from a groove (101) of a hollow cylinder body (100);

placing an edge of a coreless paper roll into the groove (101);

securing the edge within the groove (101) by pressing the side strip (200) into the groove (101) such that the side strip (200) is magnetically attracted to the hollow cylinder body (100); and rotating the hollow cylinder body (100) until the coreless paper roll is completely sleeved on the hollow cylinder body (100).

8. A method according to claim 7, further comprising removing the hollow cylinder body (100) from the coreless paper roll by applying an axial pushing force to one end of the hollow cylinder body (100).

9. A method according to claim 7, further comprising placing the hollow cylinder body (100) with the coreless paper roll sleeved thereon into a toilet paper holder for dispensing of paper.

10. A method for manufacturing a coreless roller, comprising the steps of:

manufacturing a cylinder body (100) with suitable inner and outer diameters and cutting the cylinder body (100) into unit lengths;

forming an axial groove (101) on an outer side of the cylinder body (100);

drilling a plurality of holes in a bottom of the groove (101);

placing a first set of magnetic attractors (102, 201) in the holes with glue; and fixing a second set of magnetic attractors (102, 201) to an inner part of a side strip (200) with glue.

* * * * *